US005802899A

United States Patent [19]

Klaas et al.

[11] Patent Number: 5,802,899

[45] Date of Patent: Sep. 8, 1998

[54] METHOD FOR INTERNAL HIGH-PRESSURE DEFORMING OF HOLLOW OFFSET SHAFTS MADE OF COLD-DEFORMABLE METAL

[76] Inventors: Friedrich Klaas, Achalmstrasse 24, D-73432 Aalen; Helmut Bogel, Gabelsbergerstrasse 10, D-73431 Aalen; Georg Weber, Kapellenweg 15, D-73466 Lauchheim/Rottingen, all of Germany

[21] Appl. No.: 637,783

[22] PCT Filed: Nov. 3, 1994

[86] PCT No.: PCT/DE94/01300

§ 371 Date: Jul. 12, 1996

§ 102(e) Date: Jul. 12, 1996

[87] PCT Pub. No.: WO95/12466

PCT Pub. Date: May 11, 1995

[30] Foreign Application Priority Data

Mar. 11, 1993 [DE] Germany ..... 43 37 517.0

[51] Int. Cl.[6] ..... B21D 26/02

[52] U.S. Cl. ..... 72/58; 72/62

[58] Field of Search ..... 72/58, 61, 62

[56] References Cited

U.S. PATENT DOCUMENTS

| | | | |
|---|---|---|---|
| 2,892,254 | 6/1959 | Garvin . | |
| 3,358,488 | 12/1967 | Fuchs, Jr. | 72/62 |
| 3,845,667 | 11/1974 | Honrath et al. . | |
| 3,974,675 | 8/1976 | Tominaga | 72/58 |
| 4,317,348 | 3/1982 | Halene et al. | 72/58 |
| 4,660,269 | 4/1987 | Suzuki . | |
| 4,730,474 | 3/1988 | Iwakura et al. . | |
| 4,951,492 | 8/1990 | Vogt | 72/61 |
| 5,214,948 | 6/1993 | Sanders et al. | 72/58 |
| 5,303,570 | 4/1994 | Kaiser | 72/62 |

FOREIGN PATENT DOCUMENTS

| | | |
|---|---|---|
| 0497438A1 | 1/1992 | European Pat. Off. . |
| 4007284A1 | 3/1991 | Germany . |
| 4427201A1 | 8/1995 | Germany . |

*Primary Examiner*—David Jones
*Attorney, Agent, or Firm*—Cushman Darby& Cushman IP Group of Pillsbury Madison & Sutro, LLP

[57] ABSTRACT

The invention relates to a process for forming hollow stepped shafts of cold-formable metal by internal high pressure with the following steps: provision of a tube outlet section and filling it with fluid; sealing at least the tube section to be widened; application of a suitable high internal pressure for widening the tube section; calibration of the workpiece by applying a high calibration pressure; maintenance of the calibration pressure while heading the tube along the longitudinal axis. Internal tools, also spring-loaded tools, are provided as supports in the tool.

1 Claim, 3 Drawing Sheets

METHOD FOR INTERNAL HIGH-PRESSURE DEFORMING OF HOLLOW OFFSET SHAFTS MADE OF COLD-DEFORMABLE METAL

This application claims benefit of international application PCT/DE 94/01300 filed Nov. 3, 1994.

The invention relates to a method for internal high-pressure deforming of hollow offset shafts made of cold-deformable metal.

In general, in internal high-pressure deforming, a pipe length with a straight or nonstraight longitudinal axis is deformed by the simultaneous action of internal pressure Pi and axial force Pa. Some internal highpressure deforming methods are described in further detail, for instance in the Tagungsband des 14. Umformtechnischen Kolloguiums in Hannover 1993 [Proceedings of the Fourteenth Symposium on Deformation Technology, Hannover, 1993], page 9, which is hereby entirely incorporated by reference.

Figure 1:
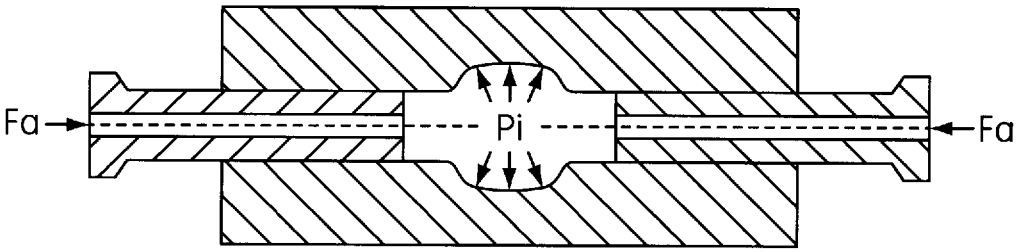
Figure 2A:
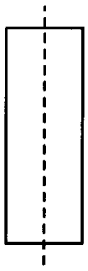
Figure 2B:
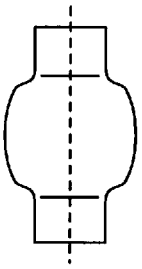
Figure 2C:
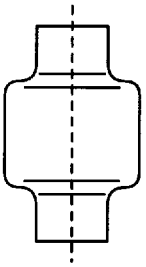

Internal high-pressure deforming of typical hollow-shaft-like workpieces is conventionally done in two deformation phases as shown in FIGS. 1 and 2. After the pipes are filled, they are first flared. Here the principles of free flaring, or in other words non-tool-bound flaring, apply. The pipe surface is curved; the contact that occurs between the workpiece and the tool at the end of this first deformation phase initially extends over only a portion of the workpiece surface. In the further deformation phase, the workpiece is made, by means of calibration, to rest entirely against the internal shape of the forming tool. The course of the wall thickness in the longitudinal section of hollow shafts made in this way is as a rule approximately 15% of the initial wall thickness So of the lengths of pipe; see FIG. 3. The course of the wall thickness is dependent primarily on the expandability of the pipe materials. The free flaring length or buckling limit, in the internal high-pressure deforming methods known until now, is at maximum 2xdo, where do is the diameter of the initial pipe.

The object of the present invention is to create an improved internal high-pressure deforming method that makes it possible to produce high-quality hollow shafts.

According to the invention, this object is attained by the method in accordance with claim 1.

The method of the invention is especially suitable for hollow shafts of the kind described for instance in German Patent Application P 40 07 284.3. This relates for instance to drive shafts of a motor vehicle with a middle tubular region which has a greater outer diameter and a thin wall thickness, and end regions on both sides which have a thick wall thickness. The differences in wall thickness in these shafts, and the free flaring length, are many times greater than the method limits known until now in internal high-pressure deforming.

By the method of the invention, the following advantages, among others are attained:

1. The production of hollow shafts with a course of wall thickness in longitudinal section that has wall thickness differences of far more than 15%, referred to $S_o$.

2. The production of hollow shafts with a flaring length of far more than 2xdo.

Figure 3:
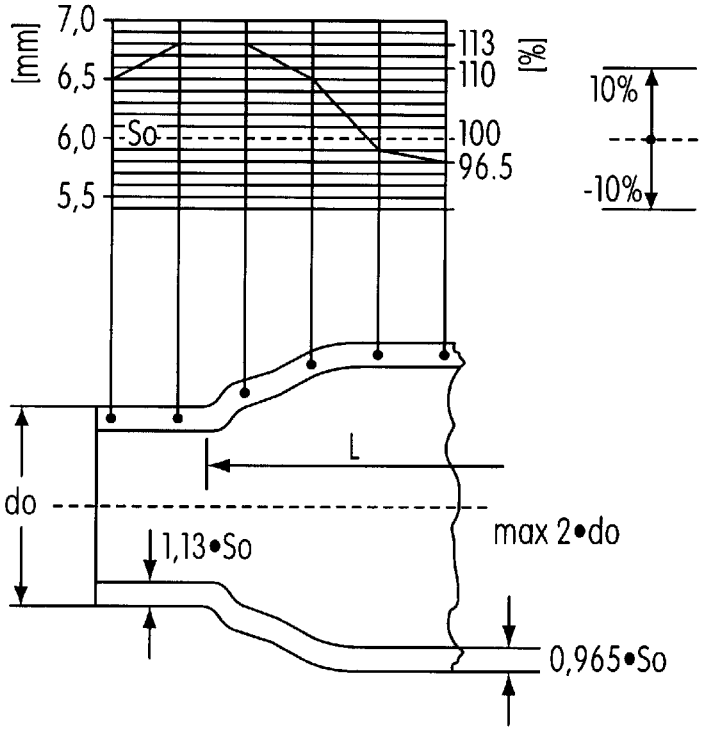
Figure 4:
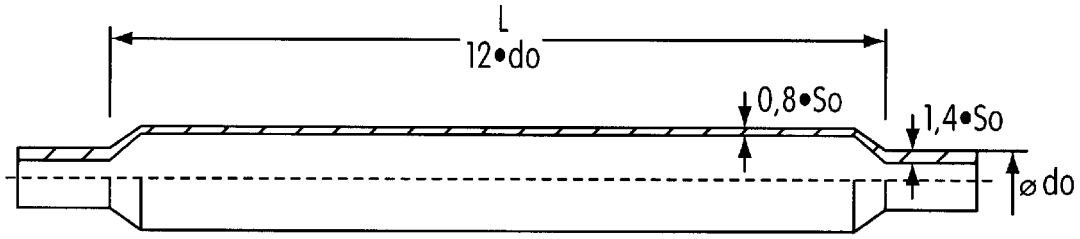
Figure 5A:
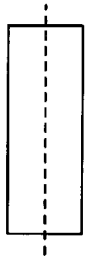
Figure 5B:
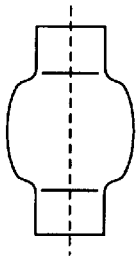
Figure 5C:
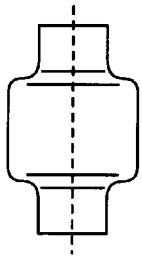
Figure 5D:
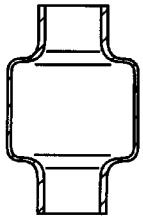

The method of the invention will be described in further detail below in conjunction with the drawing. Shown are:

FIG. 1, a schematic internal high-pressure method;

FIG. 2, a succession of method steps for producing a partially flared pipe;

FIG. 3, the course of wall thickness of a flared pipe;

FIG. 4, one example of an object made according to the invention; and

FIG. 5, schematically, an ensuing method step.

As seen particularly from FIG. 2, a method product as shown in FIG. 4 is produced by first filling the pipe with a fluid, which may be a gas or a highly volatile liquid. Next, flaring is done, by sealing off the pipe ends in a manner known per se and applying an internal high pressure. After the flaring in phase 1 and calibration of the hollow body in phase 2, the high calibration pressure is maintained or even further increased in phase 3.

According to the invention, as seen particularly in FIG. 5, upsetting of the shaped long pipe is now carried out.

The first part of the object of the invention is attained by appending to the two deformation phases a third deformation phase, shown in FIG. 5. After the flaring in phase 1 and calibration in phase 2, in phase 3 the high calibration pressure is maintained or further increased. This high internal pressure makes it possible to slip the pipe ends over one another without producing creasing in the pipe wall. Upsetting of the wall of the workpieces in the receiving region necessary takes place, by virtually arbitrary amounts. Such an operation can be achieved by suitable control technology for the deformation machine. A suitable pipe wall thickness So must be chosen, so as to attain the optimal graduation of wall thickness in the thinner flaring region and the thick end region.

Figure 6:
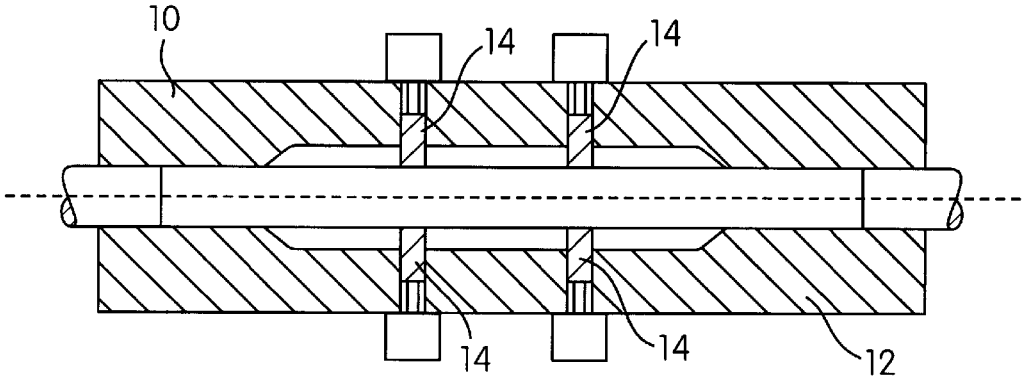

The second part of the object is attained by technical provisions relating to tool or die halves 10, 12 (FIG. 6). Bracing elements 14 in each tool 10, 12, prevent the long pipe shafts from buckling. As can be appreciated from the Figures, these bracing elements are urged towards the pipe during high-pressure deformation. These bracing elements may also be resiliently mounted so as to be spring biased into its extended position as shown. Depending on the length of the pipe shafts, one or more elements 14 must be disposed in the longitudinal direction of the tool 10, 12.

We claim:

1. A method for internal high-pressure deforming of hollow offset shafts of cold-deformable metal comprising the following steps:

disposing a pipe having an initial wall thickness in a tool, said tool having bracing elements resiliently mounted therein to prevent said pine from buckling while applying a longitudinally inwardly directed force to opposing end portions of said pipe;

filling said pipe with fluid;

sealing opposite ends of the pipe;

applying an internal high pressure to the fluid suitable for circumferentially expanding an intermediate portion of the pipe between opposing end portions of the pipe;

maintaining or increasing a calibration pressure of said fluid while applying said longitudinally inwardly directed force to said opposing end portions of said pipe to thereby increase the wall thickness of said opposing end portions of said pipe on opposing sides of said intermediate portion such that the wall thickness of said end portions of said pipe after said circumferential expansion is greater than said initial wall thickness.

* * * * *